US005138785A

United States Patent [19]

Paterson

[11] Patent Number: 5,138,785

[45] Date of Patent: Aug. 18, 1992

[54] LOCKS FOR FIREARMS

[76] Inventor: John L. Paterson, 1 Waterman Place, Fraser, Australian Capital Territory, 2615, Australia

[21] Appl. No.: 684,881

[22] PCT Filed: Sep. 22, 1989

[86] PCT No.: PCT/AU89/00409

§ 371 Date: Apr. 11, 1991

§ 102(e) Date: Apr. 11, 1991

[87] PCT Pub. No.: WO90/04148

PCT Pub. Date: Apr. 19, 1990

[30] Foreign Application Priority Data

Oct. 11, 1988 [AU] Australia ..... 0878

[51] Int. Cl.[5] ..... F41A 15/02

[52] U.S. Cl. ..... 42/66; 42/70.11

[58] Field of Search ..... 42/70.11, 66

[56] References Cited

U.S. PATENT DOCUMENTS

| | | | |
|---|---|---|---|
| 2,836,918 | 6/1958 | Pula et al. | 42/70.11 |
| 2,943,411 | 7/1960 | Salva | 42/70.11 |
| 3,541,819 | 11/1970 | Kerr | 70/491 |
| 4,048,741 | 9/1977 | Chiodo et al. | 42/70.11 |
| 4,412,397 | 11/1983 | Bayn | 42/70.11 |
| 4,461,108 | 7/1984 | Von Muller | 42/70.11 |
| 4,761,906 | 8/1988 | Guevara | 42/70.11 |
| 4,999,940 | 3/1991 | Madden | 42/70.11 |
| 5,001,854 | 3/1991 | Derman | 42/70.11 |
| 5,016,377 | 5/1991 | Gunning | 42/70.11 |

*Primary Examiner*—Michael J. Carone

*Attorney, Agent, or Firm*—Sughrue, Mion, Zinn Macpeak & Seas

[57] ABSTRACT

A lock for a firearm with a revolving bullet-receiving cylinder is insertable into one of the chambers of the cylinder when the cylinder is in an open position. The lock comprises a body, insertable through a chamber and then expandable at a foot portion by turning a key in order to prevent withdrawal of the body. While the body remains within the cylinder, the cylinder cannot be closed and the firearm cannot be discharged.

5 Claims, 2 Drawing Sheets

LOCKS FOR FIREARMS

The present invention relates to a lock for a firearm and more particularly to a lock for a pistol or other firearm with a revolving cylinder, a so-called revolver, in order to render the firearm safe when not in use.

Difficulties arise in rendering firearms, particularly small firearms such as revolvers, safe when not in use. It is conventional to remove the bullets from the cylinder, but this does not disable the weapon. In an attempt to provide a disabling function for the weapon, the Police may sometimes put a handcuff through the trigger guard in order to prevent operation of the trigger. Such a practice is not satisfactory and has given rise to accidents in instances where not all of the bullets have been removed from the cylinder.

An object of the invention is to provide means which can be used with existing firearms in order to disable the firearm against operation.

According to the present invention, there is provided a removable lock for a firearm having a revolving cylinder with bullet-receiving chambers, said lock comprising a body portion sized for insertion into one of the chambers when the cylinder is in open position, and means for preventing removal of the body portion from the chamber so as to prevent closure of the cylinder.

An embodiment of the invention will now be described by way of example only with reference to the accompanying drawings, in which.

Figure 1:
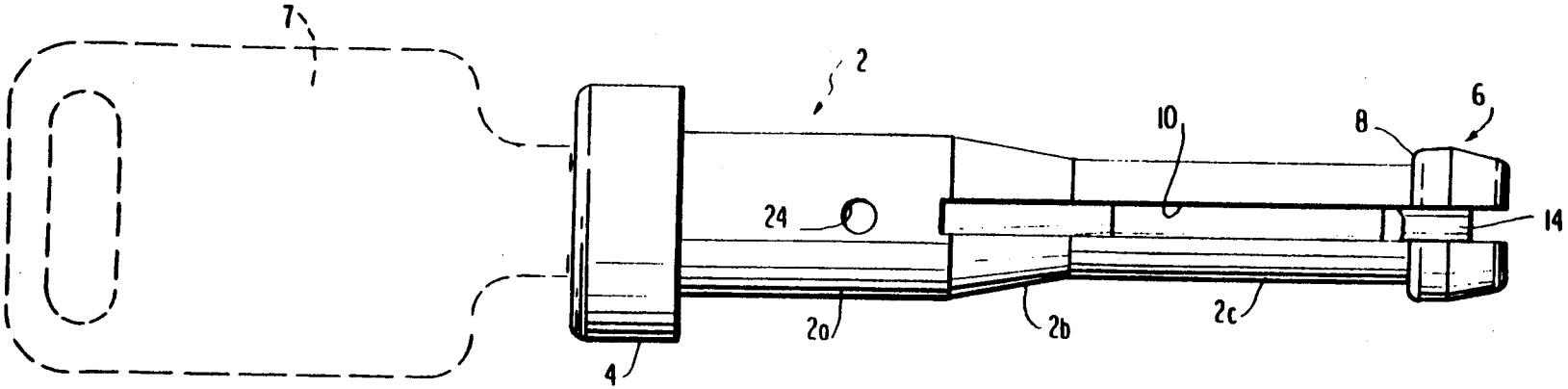
FIG. 1 is a side view of a lock in accordance with the invention.

The lock shown in the drawings is intended to be placed into one of the bullet-receiving chambers of the revolving cylinder of a revolver when the cylinder has been swung into its open position, that is the position which the cylinder occupies to permit loading of bullets into the cylinder. The lock prevents closing of the cylinder and, in turn, prevents operation of the hammer and trigger mechanisms as most weapons have interlock features which prevent operation of these mechanisms whilst the cylinder is open. Even if such interlock mechanisms are not present, the locking of the cylinder in its open position will ensure that none of the chambers of the cylinder is able to align with the barrel of the weapon.

The lock comprises a substantially cylindrical body 2 of a maximum diameter approximately the same as that of a bullet for use in the weapon so that the body is able to fit into one of the chambers of the cylinder. An enlarged head 4 at an outer end of the body 2 is of greater diameter than the chamber diameter and abuts against an axial end face of the chamber in the fully inserted position of the lock. The overall length of the body 2 is greater than that of the chamber and in the fully inserted position of the lock, a foot portion 6 of the body 2 at the opposite end to the head 2 projects beyond the other end of the chamber. The foot portion 6 is either expandable or incorporates an expandable element which can be activated by a key 7 so as to prevent withdrawal of the lock.

In the particular embodiment shown, the body 2 is of tubular form. In a portion 2a adjacent the head 4, the body is of a diameter equivalent to that of a bullet for use in the weapon. The outer diameter of the body then reduces progressively over an inclined transition zone 2b to a constant diameter portion 2c at the other end portion of the body. This constant diameter portion is then enlarged by means of the foot portion 6 which steps outwardly to define an abutment surface 8 which faces rearwardly towards the head 4. The foot portion 6 has, in a non-activated state of the lock, an outer diameter which is no greater than, and which is preferably less than, the diameter of the larger portion 2a of the body, to enable the foot portion to pass through the length of the chamber. The axial distance between the head 4 and the axial abutment surface 8 of the foot portion 6 is greater than the length of the chamber in order to ensure that when the head portion is against one axial end face of the chamber (normally, the rear end face), the foot portion will be beyond the other axial end face of the chamber (normally, the front end face).

The body 2 is split longitudinally by diameterically opposed slots 10 extending axially from the end of the foot portion 6 over a substantial part of the length of the body to enable the foot portion 6 to resiliently expand radially upon activation of the lock to a diameter greater than that of the chamber whereby any attempt to withdraw the lock will result in the abutment surface 8 engaging the front end face of the chamber.

Figure 2:
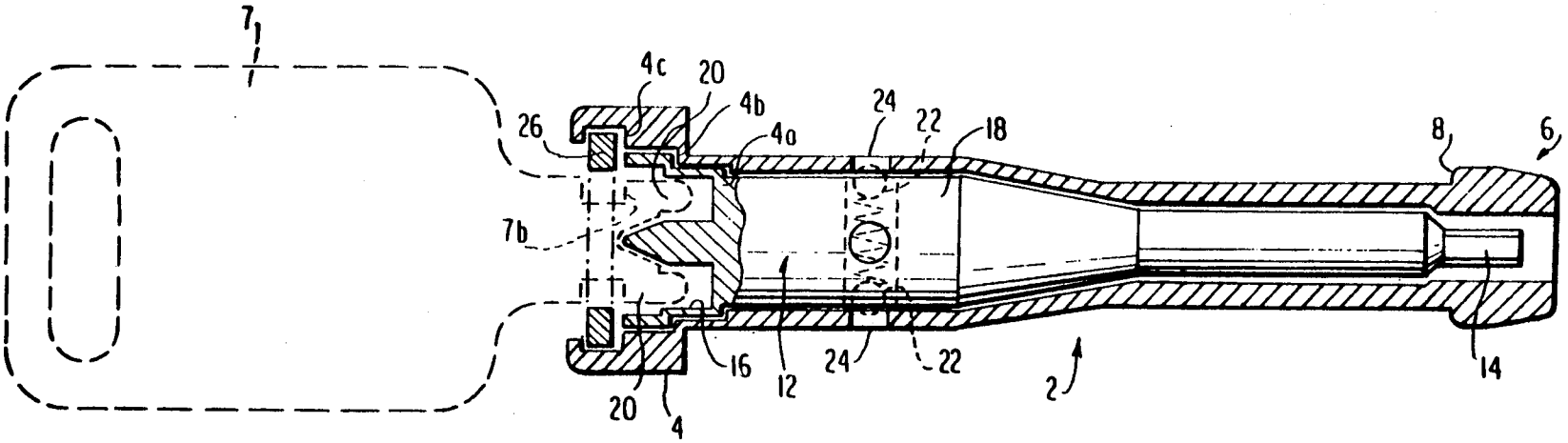
FIG. 2 is a fragmentary longitudinal section of the lock.

As shown in FIG. 2, the head 4 is of a stepped internal diameter in order to provide primary seats 4a, 4b at the inner end of the head and a further seat 4c of larger diameter at the outer end of the head.

Figure 4:
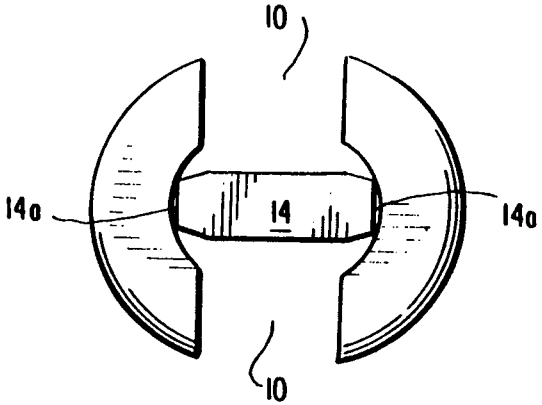
FIG. 4 is an end view showing the lock in an activated condition.
Figure 3:
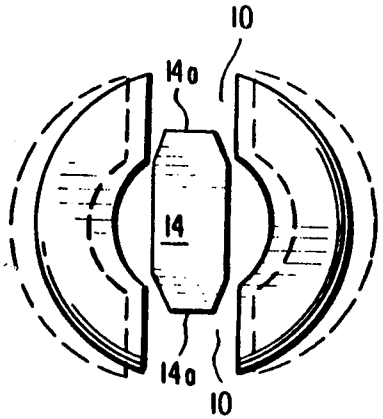
FIG. 3 is an end view showing the lock in a non-activated condition.

The tubular body 2 of the lock receives an inner body 12 which is rotatably mounted within the body 2 and which includes, adjacent to the foot portion 6, a cam 14 which acts to expand the foot portion 6 radially upon rotation of the inner body 12 relative to the outer body 2. The inner body 12 comprises a head portion 16 shaped to fit within the seats 4a and 4b and a shank portion 18 sized and shaped to fit within the outer body 2. At its outer or forward end, the shank portion 18 is shaped to define the cam 14 which is of approximately plate-like rectangular configuration with inclined corner zones as shown in FIGS. 3 and 4. In a first angular orientation of the inner body 12 relative to the outer body 2, corresponding to a non-activated condition of the lock, the opposed ends 14a of the cam 14 are aligned with, and extend partly into, the longitudinal slots 10 in the body 2. This configuration is shown in solid lines in FIG. 3. In a second angular orientation at right angles to the first and corresponding to an activated condition of the lock, the cam 14 has rotated into a position in which the ends 14a of the cam 14 have expanded the foot portion 6 to a diameter greater than the diameter of the chamber. This condition is shown in FIG. 4 and in broken lines in FIG. 3. In this condition, the abutment faces 8 will prevent withdrawal of the foot portion 6 rearwardly through the chamber lock.

Rotation of the inner body 12 is affected by means of the key 7, which is of plate-like form having projections 20 which engage into recesses formed in the head portion 16 of the inner body 12. The inner body 12 is releasably held in the activated and non-activated orientations by means of a detent mechanism comprising spring loaded balls 22 retained in a transverse passage in the shank portion 18 to engage in apertures 24 formed in the outer body 2.

The inner body 12 is retained within the outer body 2 by means of a washer 26 mounted within the outer seat 4c of the head 4, the outer rim of the head 4 being deformed inwardly after assembly in order to retain the washer 26 and thereby to prevent removal of the inner body 12. Preferably, the washer 26 is internally slotted to permit insertion and removal of the key 7 only when the inner body 12 has been rotated into the activated, locked, orientation. In the non-activated orientation, the key 7 will have rotated with the inner body 12 into a position in which a shoulder 7b of the key prevents withdrawal of the key through the slot in the washer. This ensures that in the non-activated condition of the lock, the lock will remain attached to the key and can be hung by the key from a key ring or the like.

To use the lock, the cylinder of the weapon is swung open, and one bullet is removed. The lock is inserted in its non-activated state into the empty chamber so that the head lies adjacent the rear end of the chamber and the foot portion projects beyond the front end of the chamber, and then the key is turned through 90° in either direction in order to expand the foot portion and thereby prevent removal. The key can then be removed thereby leaving the weapon in a safe locked state in which the weapon cannot be fired. To remove the lock, the key is inserted to turn the inner body through 90° in either direction whereby the foot portion resiliently contracts, thereby enabling the lock to be withdrawn. By appropriately sizing the length and diameter of the body of the lock, a single-sized lock can be produced for more than one size of weapon, although the complete range of weapon sizes currently available will require a range of lock sizes. It will however be appreciated that the length of the outer body between the head and the foot portion should be at least the length of the cylinder of each weapon in the range for which the particular lock is designed, and the diameter of the outer body should be no greater than the diameter of the smallest bullets of the range of weapons.

The lock may be fabricated from a hardened metal or a toughened plastics.

The embodiment has been described by way of example only and modifications are possible within the scope of the invention.

I claim:

1. A removable lock for a firearm having a revolving cylinder with bullet-receiving chambers, said lock comprising:

a body portion sized for insertion into one of the chambers when the cylinder is in an open position;

means for preventing removal of the body portion from the chamber so as to prevent closure of the cylinder and comprising an expandable element located at or adjacent to an end of the cylinder when the body portion is within the chamber; and a key-actuated rotary element for expanding the expandable element; wherein the body portion comprises an outer tubular body having at one end a head of a transverse dimension greater than the diameter of the chamber, the expandable element is at the opposite end of the body and in an unexpanded condition has a transverse size less than the diameter of the chamber to enable said opposite end of the body to pass through the chamber, the expandable element when in an expanded condition being of such a transverse size that withdrawal of said opposite end of the body through the chamber is prevented;

the key-actuated element comprises an inner body mounted within the outer body for rotation about the axis of the outer body, the inner body having a cam movable on rotation of the inner body to effect expansion of the expandable element; and the outer body includes longitudinal slots extending from said opposite end and the expandable element is defined by formations provided on said opposite end such that rotation of the cam effects radially outward movement of the formation by opening of the longitudinal slots.

2. A lock according to claim 1, further comprising detent means for releasably holding the inner body in positions equivalent to the expanded and unexpanded conditions of the expandable element.

3. A lock according to claim 1, comprising means for prevent removal of a key when the expandable element is in its unexpanded condition.

4. A lock according to claim 1, wherein the inner body includes a head part within the head of the outer body, said head part including a formation shaped to engage a key inserted through the head of the outer body.

5. A lock according to claim 4, wherein the head of the outer body includes a slotted closure so shaped relative to the key that insertion and removal of the key occurs via the slot in the closure and that removal of the key is prevented when the key and inner body have been rotated into a position corresponding to the unexpanded condition of the expansion element.

* * * * *

UNITED STATES PATENT AND TRADEMARK OFFICE

CERTIFICATE OF CORRECTION

PATENT NO. : 5,138,785

DATED : August 18, 1992

INVENTOR(S) : John L. Paterson

It is certified that error appears in the above-indentified patent and that said Letters Patent is hereby corrected as shown below:

On the Title Page

[73] Assignee: Patricia Mary PATERSON
1 Waterman Place Fraser
Australian Capital Territory, 2615, AUSTRALIA and Laurie REBASE
41 Ridge Street
Epping New South Wales, 2121, AUSTRALIA Signed and Sealed this Twenty-sixth Day of October, 1993

*Attest:*

Bruce Lehman

BRUCE LEHMAN

*Attesting Officer*

*Commissioner of Patents and Trademarks*